United States Patent [19]

Hernandez

[11] 4,415,979

[45] Nov. 15, 1983

[54] METHOD AND APPARATUS FOR DETECTING THE PRESENCE OF AN ANIMATE BODY IN AN INANIMATE MOBILE STRUCTURE

[75] Inventor: Walter C. Hernandez, Potomac, Md.

[73] Assignee: Ensco, Inc., Springfield, Va.

[21] Appl. No.: 247,242

[22] Filed: Mar. 25, 1981

[51] Int. Cl.[3] ..... G08B 13/00

[52] U.S. Cl. ..... 364/508; 340/65; 340/565; 340/566; 340/573; 367/136

[58] Field of Search ..... 364/413, 508, 551; 343/6.5 SS; 367/136, 901; 340/540, 541, 565–567, 573; 455/297

[56] References Cited

U.S. PATENT DOCUMENTS

| | | | |
|---|---|---|---|
| 3,617,998 | 11/1971 | Freedman | 343/7A |
| 3,805,260 | 4/1974 | Barowitz | 340/566 |
| 3,922,663 | 11/1975 | Lubke et al. | 367/136 |
| 4,096,474 | 6/1978 | Greer et al. | 367/136 |
| 4,096,477 | 6/1978 | Epstein et al. | 343/6.5 SS |
| 4,107,775 | 8/1978 | Ott | 364/413 |
| 4,110,730 | 8/1978 | Varecka et al. | 340/566 |
| 4,190,828 | 2/1980 | Wolf | 340/566 |
| 4,223,304 | 9/1980 | Barowitz et al. | 367/136 |

*Primary Examiner*—Errol A. Krass

*Attorney, Agent, or Firm*—Sixbey, Friedman & Leedom

[57] ABSTRACT

The present invention provides a method and detection system for determining whether a person or other animate body is present in a vehicle by analyzing the power of the output signal from a geophone placed in contact with the vehicle structure. First an electrical signal is obtained which is a function of the vibrations emanating from the structure, and this signal is sampled on a contiguous basis over a plurality of time periods of equal duration. From these samples, a determination is then made as to whether a dense accumulation of power exists in the vicinity of the lowest power point of the sampled time periods and whether this lowest power point is above a predetermined minimum level. The system for accomplishing this method may include a seismic transducer used as a sensing device and a micro-computer for processing the output signals from the seismic transducer. The micro-computer will, on a continguous basis, sample about $2\frac{2}{3}$ seconds of data at a time. The total power from each of these $2\frac{2}{3}$ second data segments is calculated. If the computer sees that there is a dense accumulation of power at the lowest power point and above and that this is larger than a minimum requirement, then it will signal the presence of one or more concealed persons. There is a variable operating time as the computer continuously accumulates new data and, hence, new power points. It will collect data until it has sufficient information to make a reliable decision. In a quiet environment this may be 6–10 seconds whereas, in a noisy environment it may be two minutes or longer.

14 Claims, 4 Drawing Figures

METHOD AND APPARATUS FOR DETECTING THE PRESENCE OF AN ANIMATE BODY IN AN INANIMATE MOBILE STRUCTURE

TECHNICAL FIELD

The present invention relates generally to a method for detecting the presence of animate bodies concealed in a vehicle, and more particularly to a method and apparatus for detecting concealed persons in a vehicle by analyzing the powere of vibrations emanating from the vehicle structure.

BACKGROUND ART

In recent years, the use of motor vehicles or other mobile structures to illegally transport concealed individuals has become a problem of significant dimension. Aliens attempting to enter the United States or other countries without proper documentation or authority often conceal themselves in vehicles during border crossings and thus avoid detection. Border guards and other government officials charged with the responsibility for preventing such illegal entry have in the past been forced to resort to an unsatisfactory combination of intuition, circumstantial evidence and uncertain legal guidelines in determining which among a large number of vehicles at a border crossing ought to be searched for hidden persons.

In recent years, some prior art devices and systems have been developed which are capable of electronically examining any given vehicle for the purpose of ascertaining whether a person or persons are concealed therein. When a person is present in a mobile or vehicular structure, interaction between the vehicle mass and the person's heartbeat, breathing, muscle reflections and other involuntary body movements generates low level mechanical vibrations, typically having a frequency in the neighborhood of from two to twenty Hertz, throughout the vehicular structure. Devices designed to detect the presence of the concealed person in the vehicle concentrate on sensing these low level vibrations in some discernable manner. Accordingly, highly sensitive geophones or other seismatic-type transducers are placed in contct with the vehicular structure to obtain the electrical analog counterpart of body-induced vibrations.

One type of seismic detection system is disclosed in U.S. Pat. No. 4,096,477 issued to Greer et al on June 20, 1978. This system analyzes a geophone signal output from a frequency perspective. The frequency component of the geophone signal output lying within the frequency range of interest, i.e., the narrow frequency range immediately surrounding four Hertz, is isolated, and zero-crossings of the isolated frequency component can then be monitored to provide an indication of the low level mechanical vibrations, and hence the presence of the person, in the vehicle.

Although frequency-based seismic detection systems provide entirely satisfactory results in a low noise environment, the technique of monitoring zero-crossings in a selected frequency range is highly sensitive to noise and ambient wind conditions. Wind can rock a car and produce low level vibrations with frequency zero-crossings quite similar to those attributable to the presence of a person in the car, thus leading to false indications of the person's presence. Wind-induced vibration can also act to cancel out the body-induced vibrations caused by the presence of a person in the car, thereby falsely masking the presence of the person.

Means for identifying information-bearing signals in the presence of large amplitude noise signals have, of course, been developed for purposes other than the detection of human beings. One such means is illustrated in U.S. Pat. No. 3,617,998, issued to Freedman on Nov. 2, 1971. With the Freedman system, randomly varying target indicating signals from a transducer are detected against a background of widely varying noise by comparing the root mean square value of the power of the target-indicating signal with the noise power. The Freedman system, however, does not relate to a simple, portable detector for onsite usage in the hands of technologically untrained operators, and the need for such a system and method for personnel detection which is capable of furnishing accurate, reliable indications in high noise, high interference environments remains.

DISCLOSURE OF THE INVENTION

It is therefore a primary object of the present invention to provide a method for detecting the presence of an animate body in a vehicular or inanimate mobile structure through the use of time domain power evaluation techniques.

Another object of the present invention is to provide a time domain power evaluation method for detecting the presence of an animate body in a vehicular structure by generating an electrical signal in response to mechanical vibrations emanating from the vehicular structure and thereafter analyzing the electrical signal to determine whether a dense accumulation of power exists adjacent a low power point of the signal.

A still further object of the present invention is to provide a time domain power evaluation method wherein an electrical signal is generated in response to mechanical vibrations emanating from a vehicular structure and a minimum power level is determined. Subsequently, a determination is made to indicate whether a dense accumulation of power exists in the vicinity of the predetermined minimum power level to indicate the presence or absence of a person concealed in the vehicular structure.

It is an additional object of the present invention to provide a method for detecting the presence of an animate body in a vehicular structure by sampling an electrical signal generated in response to mechanical vibrations emanating from the vehicular structure and then determining the mean power present in a plurality of electrical signal samples. If a dense accumulation of low mean power samples exist during a sampling period, the presence of an animate body is indicated.

It is yet an additional object of the present invention to provide a time domain power evaluation method including the steps of generating an electrical signal in response to mechanical vibrations emanating from a vehicular structure, sampling the electrical signal during a plurality of equal time periods, determining the total power present in the sample time periods to obtain a total power sample, and creating a histogram from the total power sample to ascertain whether a dense accumulation of power indicative of the presence of a concealed person in the vehicular structure exists adjacent the lowest power point of a portion of the power sample above a predetermined level.

It is a further object of the present invention to provide a time domain power evaluation method including the steps of generating an electrical signal in response to mechanical vibration emanating from a vehicular structure, integrating the analog signal, sampling the integrated signal a plurality of times over a specific sampling period, obtaining the value of the mean power amplitude during each sample, eliminating those samples having a mean power amplitude greater than twice the level of the lowest mean power amplitude present in the samples, and counting the remaining samples to determine whether dense accumulation of power indicative of the presence of an animate body in the vehicular structure exists in the region surrounding the lowest power point.

These and other objects are accomplished by bringing a transducer geophone into contact with the structure of a vehicle under investigation and obtaining a geophone output in the form of an analog signal which varies as a function of mechanical vibrations emanating from the vehicle. In one embodiment of the present invention, the geophone output is amplified, filtered and integrated, whereupon a microcomputer or other sampling unit samples the integrated signal during a plurality of equal time periods and obtains the value of the mean power amplitude for each sample period. The lowest power value among the samples is determined, and if this lowest power value is less than a predetermined minimum power value, an output indicative of the absence of any concealed persons in the vehicle is generated. If, on the other hand, the lowest power value is above the predetermined minimum power level, each sample having a mean power amplitude greater than twice the lowest power value of the samples is discarded. The remaining samples are counted to determine whether the accumulation of power existing in the region of the lowest power sample over the sampling period is sufficiently dense to indicate the presence of a concealed person in the vehicle.

In a second embodiment of the present invention, the integrator is replaced by an A/D converter, and the microcomputer or similar sampling device samples data from the A/D converter for short intervals during a sampling period. The total power present from all of the samples taken during the sampling period is calculated. A histogram analysis of the total power is then performed to obtain a power level distribution. If the microcomputer determines that a dense accumulation of power exists at the lowest power point of the total power sampled and that this lowest power point is greater than a predetermined minimum power level, a search signal indicating the presence of one or more concealed persons in the vehicle will be generated.

BEST MODE FOR CARRYING OUT THE INVENTION

Figure 1:
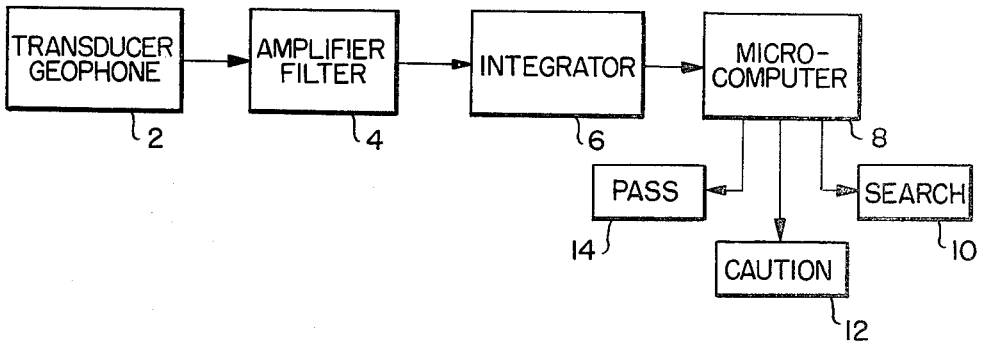
FIG. 1 is a block diagram of a microprocessor-based detection system employing time domain power evaluation techniques.

One solution to the problems associated with frequency-based seismic concealed personnel detecting systems operations in high noise, high interference environments is to employ a power perspective in analyzing geophone signal outputs. The low level vibration produced by a person present in a vehicle will always contain a minimum amount of power. This minimum amount of power in turn will always produce a minimum power level in the geophone signal output. Dense accumulations of power in the geophone signal output at the minimum power level over a period of time provide an accurate indication of the person's presence. It can be seen on reflection that wind and noise induced components do not substantially affect the fundamental power accumulation process. Hence, a power-based seismic detection system is not as subject to noise and wind-induced errors as a frequency based system. The only adjustment necessary in a power based seismic detection system is that associated with selecting the value of the minimum power level for a particular vehicle, inasmuch as the minimum power level depends upon vehicle mass.

The present invention provides several methods which may be used to accomplish the time domain power evaluation necesary to detect the presence of an animate object in an inanimate mobile structure such as a motor vehicle. All such methods involve obtaining an electrical signal which is a function of the vibrations emanating from the mobile structure and then sampling the electrical signal over a plurality of time periods of equal duration. Once the samples are obtained, several different procedures may be employed to determine whether a dense accumulation of power exists in the vicinity of the lowest power point of the sampled time periods. If this dense accumulawtion of power does exist, it is then important to determine if the lowest power point is above a predetermined minimum power point which will always be present with an animate object present in the inanimate mobile structure. With the lowest power point below this predetermined minimum, there can be no animate object present regardless of power density. However, if the animate object is present, the minimum power point will be above the predetermined minimum level and it will be found the that a dense accumulation of power does exist in the vicinity of this low power point. When this occurs, an alarm indication can be generated.

Obviously, as the mass of the inanimate mobile structure changes, the power point at which an animate object must be present also changes. Thus, for example, in a light vehicle, the presence of a concealed human will generate a signal with a much higher minimal power point level than will the presence of a human in a vehicle of much greater mass. Consequently, in employing the method of the present invention, the predetermined minimum power level used in accomplishing the method may be altered in relation to the mass of the mobile structure under evaluation.

A simple procedure for accomplishing the method of the present invention is to employ a geophone to convert the vibraions emanating from an inanimate mobile structure into an analog signal which is then integrated. Samples of the integrated signal are then taken during a plurality of sampling periods of equal duration, and the mean power level of each sample taken during a single sampling time period is determined. All samples having a mean power level which is more than double the mean power level of the sample having the lowest mean power level taken during the sampling duration are then discarded, and the lowest mean power level is compared with the predetermined minimum power level. If the lowest mean power level exceeds the predetermined minimum power level, then the number of undiscarded samples are considered. Should a relatively large number of these samples remain from the sample duration, then the power density in the vicinity of the minimum power level is great indicating that a concealed animate object is likely to be present.

A more sophisticated procedure for determining whether a dense acumulation of power exits at the lowest power point of the sampled time periods involves the use of a histogram. The analog signal from the geophone is converted to a digital signal, and this digital signal is sampled for a plurality of equal sample periods during a sampling duration. Preferably, these sampling periods are consecutive, and the total power level present in the samples is then determined. The power level, or a logarithmic function thereof may be used to create a histogram which indicates the density of the power accumulations at the low power point level of the sampled time periods. This low power level is then compared with the predetermined minimum power value, and if it is above the minimum power value and a dense accumulation of power exists in the vicinity of the low power level, an alarm indication is generated.

The method of the present invention may be performed by conventional logic systems adapted to sample a signal over a plurality of sampling periods and to then convert each sample to a mean power level and compare each such mean power level with the lowest level obtained. Comparators may also be employed to compare the lowest level obtained with the predetermined minimum power level. Alternatively, the samples from the sampling unit may be combined and converted to a total power sample for use in creating a histogram. Ideally, however, the signal sampling and comparison functions are effectively controlled by a microprocessor.

One embodiment of a seismic detectionsystem applying the principals of the present invention is illustrated in FIG. 1. The system includes a transducer geophone 2 which is placed in physical contact with a structural component such as a hood, trunk or fender of the vehicle under investigation. Transducer geophone 2 exhibits the sensitivity and frequency response necessary to detect the low frequency vibrations produced by a person or persons concealed in the vehicle. Mechanical vibrations in the vehicle structure are sensed by the geophone and converted into an analog signal which varies as the function of the mechanical vibrations. This analog signal is amplified and filtered in amplifier/filter circuit 4 and supplied to an electrical integrator 6. Integrator 6 subsequently produces an output representative of the time integral of the analog signal. The integrator output is continuously sampled by a microcomputer 8, analyzed in terms of power content, and subjected to a series of calculations as discussed in greater detail hereinbelow. These calculations ascertain whether the analog signal as a whole contains dense accumulations of power within a predetermined low power range.

The existance of a dense accumulation of power at a level above the minimum value of the predetermined power range is indicative of the presence of a concealed person or persons in the vehicle and a suitable search display 10 is activated to alert the system operator to this fact. In a similar manner, indeterminate power accumulations within the predetermined power range lead to energization of a caution display 12 indicating the possible presence of a concealed person or persons, while the absence of dense power accumulations in the power region of interest leads to energization of a pass display 14 indicating no concealed animate objects.

Figure 2:
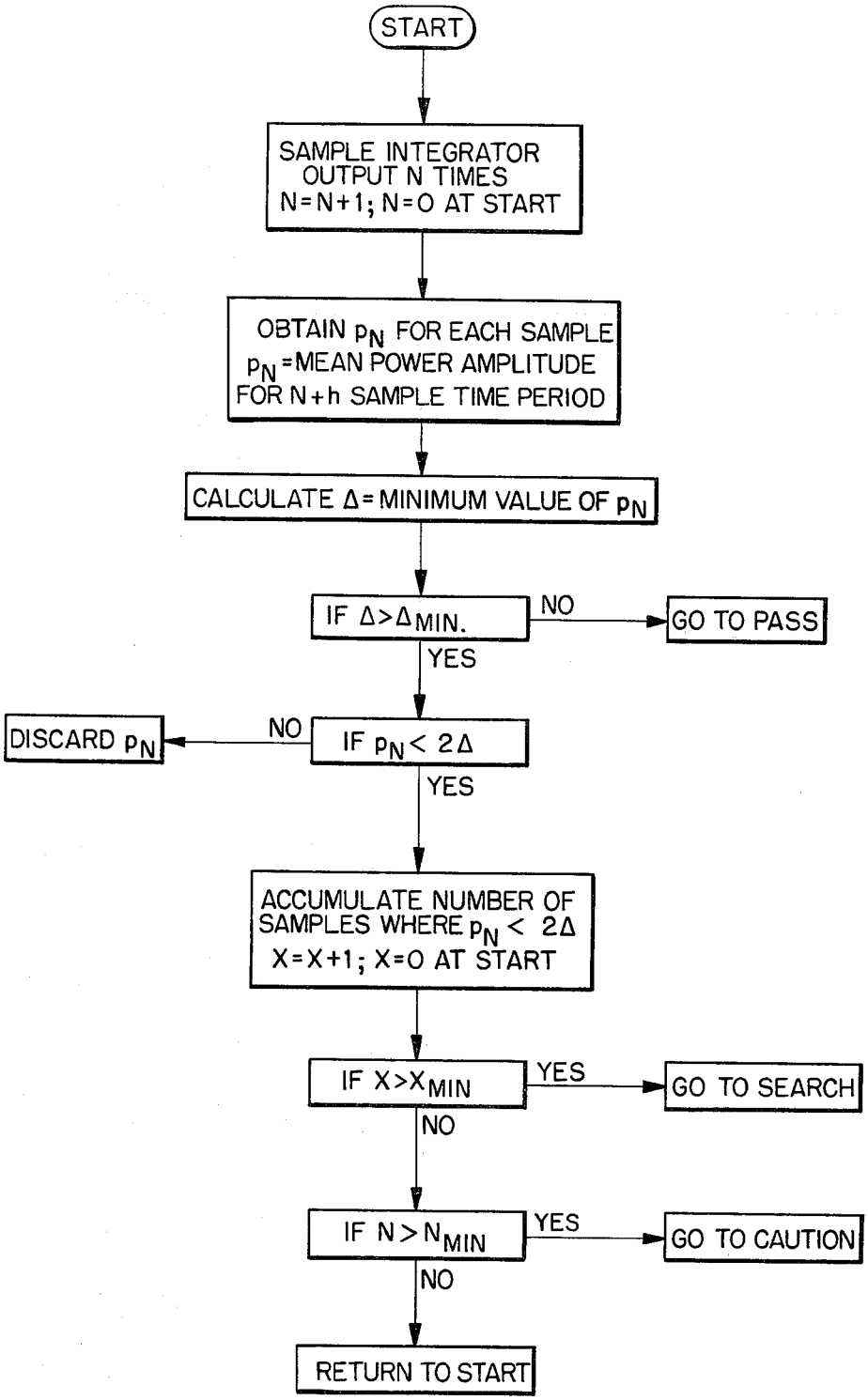
FIG. 2 is a flow chart detailing the operation performed by the detection system of FIG. 1.

A flow chart outlining the basic calculation performed by microcomputer 8 of FIG. 1 is illustrated in FIG. 2. The output from integrator 6 is sampled N times for equal periods during a sampling duration, and each sample is analyzed to obtain a value pN representing the mean power amplitude for that sample period. The minimum or lowest power point $\Delta$ present among the samples is then identified. If $\Delta$ is less than a predetermined minimum power level $\Delta_{MIN}$, no person is present in the vehicle and a pass indication is given. If, however, $\Delta$ is greater than $\Delta_{MIN}$, the mean power amplitude of each sample is examined to determine whether it exceeds a value equal to twice the value of the lowest power point $\Delta$. Those samples exhibiting excessive power, i.e., samples where $p_N$ is greater than twice the value of $\Delta$, are discarded, and those samples remaining are stored. A running talley X of the number of stored samples is kept, and at the end of the sampling period, this running talley is compared to a preset number $X_{MIN}$. If X exceeds $X_{MIN}$, a dense accumulation of power at the lowest power level of the sampled duration exists, and a search indication is given. If the accumulation of power at the lowest power level is not sufficiently dense, that is, if X is less than $X_{MIN}$, the size of the sample N is evaluated to determine whether more sampling would be beneficial. Such a situation may arise, for example, in a high noise environment where the low level vibrations imparted to the vehicle structure by a concealed person are periodically masked by much larger power inputs due to the noise. Consequently, more samples of the analog signal output from geophone transducer 2 must be taken in order to effectively detect the low level vibrations. The need for additional sampling is indicated whenever N is greater than $N_{MIN}$. Finally, when a large sample has already been taken, but still no truely dense accumulation of low power is present, a caution indication is given to underscore the existence of some low power readings possibly attributable to concealed persons.

Figure 3:
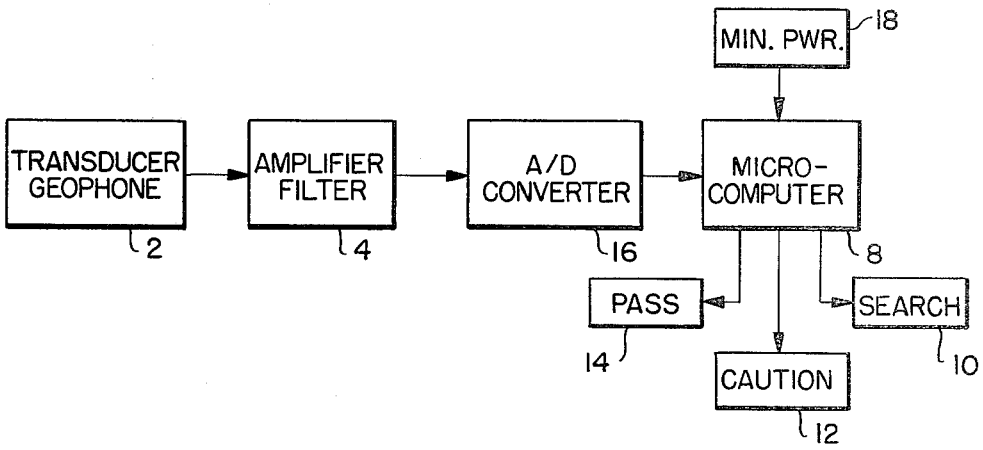
FIG. 3 illustrates a second embodiment of a microcomputer-based detection system using time domain power evaluation techniques.
Figure 4:
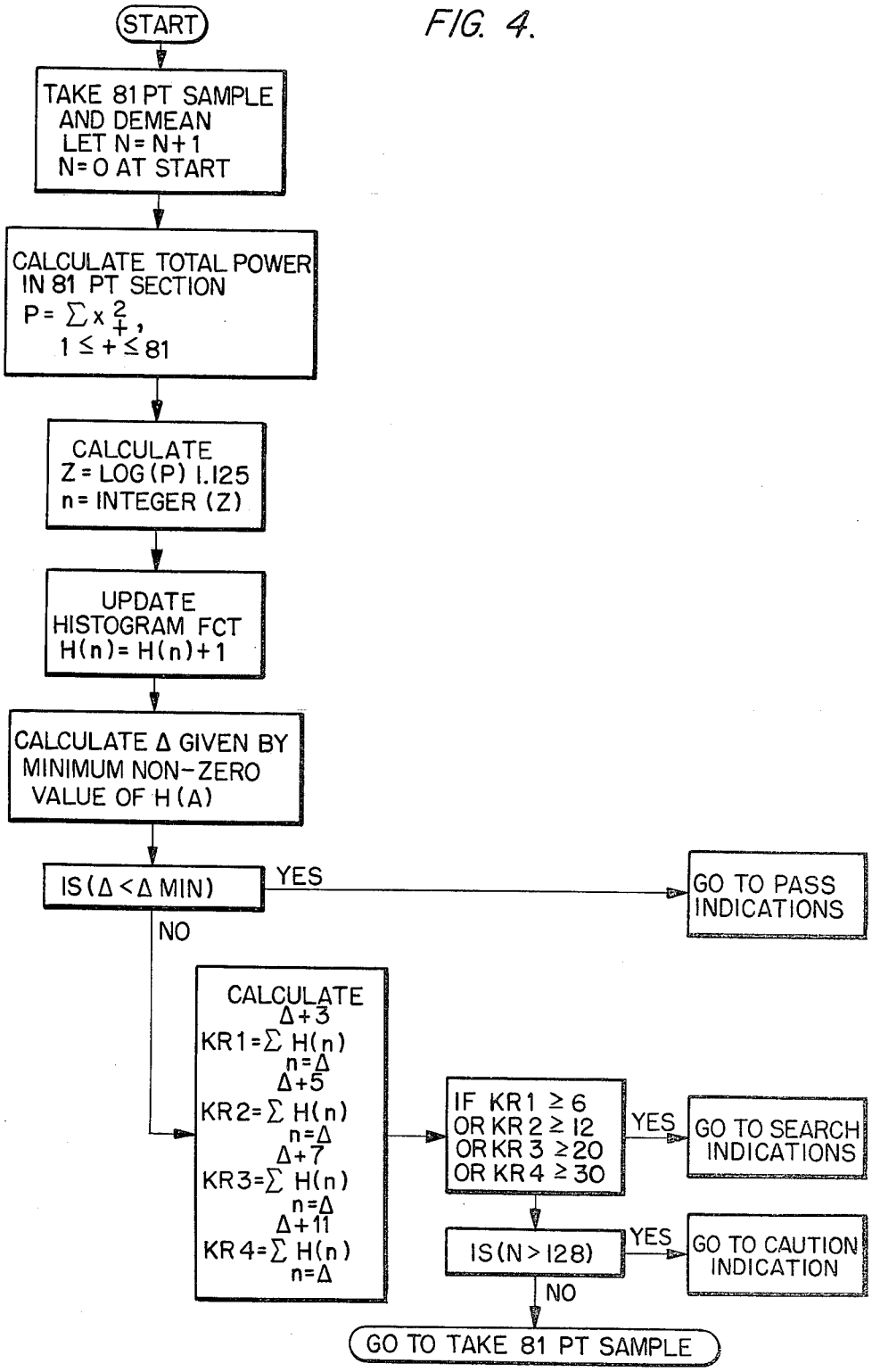
FIG. 4 is a second flow chart for an alternative set of operations performed by the microprocessor of FIG. 1.

An alternate system employing the geophone 2, amplifier and filter 4 and microcomputer 8 is shown in FIG. 3. Here, the integrator 6 of FIG. 1 is replaced by an analog to digital converter 16 which supplies a digital signal indicative of the analog signal from the amplifier and filter 4 to the microcomputer 8 in response to sample requests from the microcomputer. As shown in the flow chart of FIG. 4, this system samples the output from the analog to digital converter N times, with each sample period, for example, approximating two and two thirds seconds in duration. A time domain power evaluation across the entire sampling period is performed and the total power of all of the individual samples taken together is calculated. A histogram analysis is then carried out using the total power calculation. In particular, a logarithmatic function Z of the total power P is developed and an integer representation n of Z is established. The histogram function H(n) itself is thereafter updated for each of the integers n. A low power point $\Delta$ given by the minimum non-zero value of H ($\Delta$) is then determined and compared with a minimum power level $\Delta_{MIN}$ set into microcomputer 8 with a keyboard or other level set unit 18 in accordance with the mass of the vehicle being examined. If $\Delta$ is less than the minimum power level $\Delta_{MIN}$, no person is present in the vehicle and a pass indication is given. If on the other hand $\Delta$ is greater than $\Delta_{MIN}$, the accumulation of power at the low power point, as represented by the "sharpness" or steepness of the histogram function H(n) in selected regions encompassing the low power point, is examined for density. Where large histogram values in the selected regions evidence sufficient density, a search indication is given. Where the accumulation of power at the low power point is not sufficiently dense, the sample size is evaluated and either the sampling process is repeated or a caution indication underscoring the possibility of concealed persons is given.

INDUSTRIAL APPLICABILITY

The seismic detection system of the present invention is capable of detecting animate bodies such as persons concealed in inanimate mobile or vehicular structures. The time domain power evaluation technique employed by the seismic detection system furnishes a basis for swift, accurate determinations of the present or absence of the animate body in the vehicular structure. In particular, this time domain power evaluation technique is not substantially affected by wind or noise-induced perturbations, and thus the error or false indication rate experienced by the seismic detection system of the present invention is significantly reduced.

I claim:

1. A time domain power evaluation method for detecting the presence of an animate body in an inanimate mobile structure which includes:

a. sensing the mechanical vibrations emanating from a mobile structure and deriving therefrom an electrical signal which is a function of such vibrations;

b. sampling said electrical signal during a plurality of equal time periods and obtaining the power level of said sampled electrical signal during said equal time periods;

c. determining whether an accumulation of power levels of a selected magnitude exists within a selected power range of power levels close to but above the lowest power level obtained during said sampled time periods;

d. determining whether said lowest power level is above a predetermined minimum power level;

e. and providing an output indication in the presence of an accumulation of power levels at or in excess of said selected magnitude in said selected power range when said lowest power level is above said predetermined minimum power level.

2. The time domain power evaluation method of claim 1, which includes changing the value of said predetermined minimum power level in relation to the mass of said inanimate mobile structure.

3. The time domain power evaluation method of claim 1, which includes determining the total mean power amplitude of the signal sampled in said equal time periods to obtain a total power sample, and subsequently determining whether said accumulation of power levels at or in excess of a selected magnitude exists within said selected power range.

4. The time domain power evaluation method of claim 3, which includes creating a histogram from said total power sample to determine the magnitude of the accumulation of power within said selected power range.

5. The time domain power evaluation method of claim 4, which includes obtaining a varying analog signal which is a function of the vibrations eminating from said mobile structure and converting said analog signal into a digital signal prior to sampling.

6. The time domain power evaluation method of claim 5, which includes sampling said digital signal during a plurality of equal, contiguous time periods.

7. The time domain power evaluation method of claim 1, which includes obtaining a varying analog signal which is a function of the vibrations eminating from said mobile structure, integrating said analog signal, sampling said integrated signal and obtaining a means power amplitude during each sample time period.

8. The time domain power evaluation method of claim 1 which includes sampling said electrical signal during a plurality of contiguous equal time periods to obtain a signal segment occurring during each such time period, obtaining the mean power amplitude of each such signal segment, and determining whether an accumulation of power of a selected magnitude exists in the vicinity of the lowest mean power amplitude obtained during said sampled periods by determining whether the number of segments having a mean power amplitude within the range of said selected magnitude are sufficient with respect to a predetermined density number to indicate a dense accumulation of power.

9. A power domain power evaluation detection device for detecting the presence of an animate body in an inanimate mobile structure comprising:

a. transducer means for sensing low frequency vibrations emanating from said inanimate mobile structure and adapted to produce an analog signal which is a function thereof;

b. conversion means connected to receive said analog signal and provide a converted output signal which is a function thereof;

c. sample and power evaluation means connected to sample said converted output signal for a plurality of equal time periods during a sampling time duration, said sample and evaluation means including means to obtain the means power amplitude of said converted output signal sampled during said equal time periods, means to determine whether the lowest mean power amplitude obtained from said sampled output signal is of at least a selected power value, means to determine whether an accumulation of mean power amplitudes of a selected magnitude exists within a selected range of mean power amplitudes above said lowest mean power amplitude, and means to provide an indication output when said accumulation of said mean power amplitudes is equal to or greater than said selected magnitude and said lowest mean power amplitude is of at least said selected power value; and d. an indicator means connected to operate in response to said indication output.

10. The time domain power evaluation detection device of claim 9 which includes means to vary the selected power value for said sample and power evaluation means.

11. The time domain power evaluation detection device of claim 9 wherein said conversion means includes an analog to digital converter to provide a digital converted output signal.

12. The time domain power evaluation detection device of claim 9 wherein said conversion means includes electrical integrator means to provide an integrated converted output signal from said analog signal.

13. The time domain power evaluation detection device of claim 9 which includes an amplifier and filter means connected between said transducer means and said sample and power evaluation means.

14. The time domain power evaluation method of claim 8 which includes determining whether said lowest mean power amplitude is above a predetermined minimum mean power amplitude, and presetting the value of said predetermined mean power amplitude in relation to the mass of said inanimate mobile structure.

* * * * *